US005289146A

United States Patent [19]

Plumeret et al.

[11] Patent Number: 5,289,146

[45] Date of Patent: Feb. 22, 1994

[54] REVERSING CONTACTOR APPARATUS WITH LOCKING

[75] Inventors: Raymond Plumeret, Asnieres; Patrick Morinaud, Reuil Malmaison; Jacques Olifant, Nanterre; André Vergez, Villennes sur Seine, all of France

[73] Assignee: Telemecanique, France

[21] Appl. No.: 691,242

[22] Filed: Apr. 25, 1991

[30] Foreign Application Priority Data

Apr. 30, 1990 [FR] France ..... 90 05560

[51] Int. Cl.[5] ..... H01H 9/20

[52] U.S. Cl. ..... 335/160; 200/50 C

[58] Field of Search ..... 200/50 AA, 50 C, 50 CC; 335/160-161

[56] References Cited

U.S. PATENT DOCUMENTS

| | | | |
|---|---|---|---|
| 3,510,612 | 5/1970 | Ward | 335/132 |
| 4,590,387 | 5/1986 | Yoshida et al. | 200/50 C |
| 4,746,885 | 5/1988 | Ogata et al. | 335/160 |
| 4,983,788 | 1/1991 | Pardini | 335/132 |

*Primary Examiner*—Lincoln Donovan

*Attorney, Agent, or Firm*—William A. Drucker

[57] ABSTRACT

A reversing contactor apparatus in a single case is disclosed, comprising electro-mechanical locking means.

These means which comprise a mobile mechanical locking piece, further having surfaces for actuating locking switches, are placed substantially in the plane of a median dividing wall, on each side of which each of the two contactors of the apparatus are disposed; these conductors connect these switches in series to each contactor coil and, respectively, to a connection terminal.

10 Claims, 7 Drawing Sheets

FIG. 14
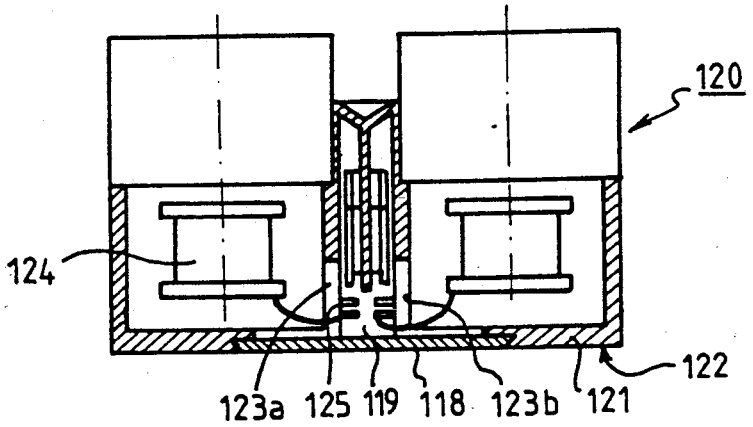
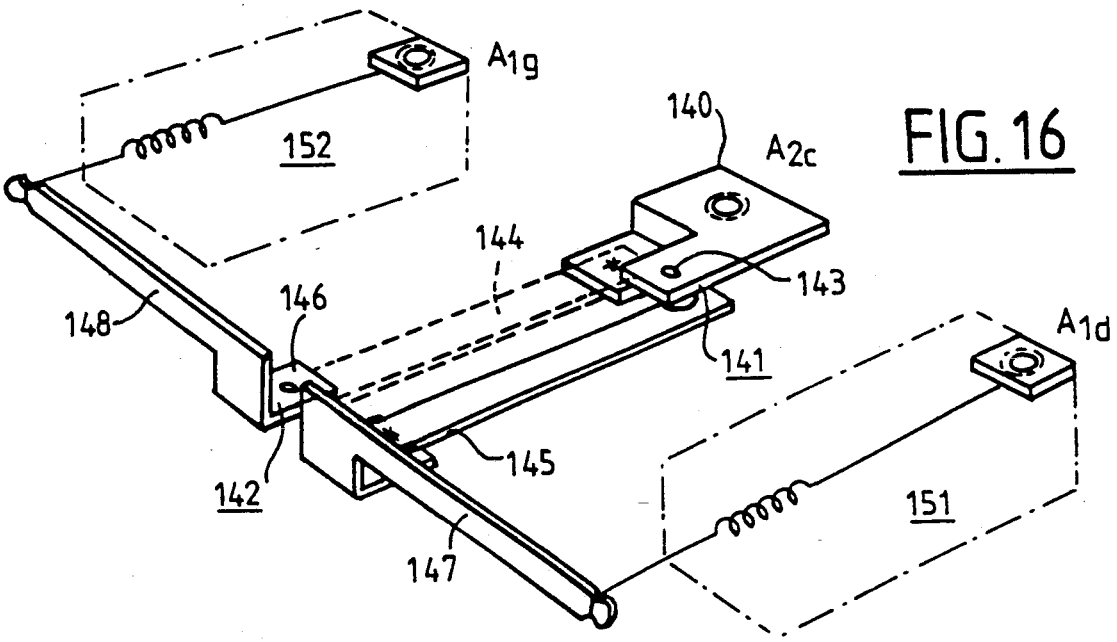
FIG. 16
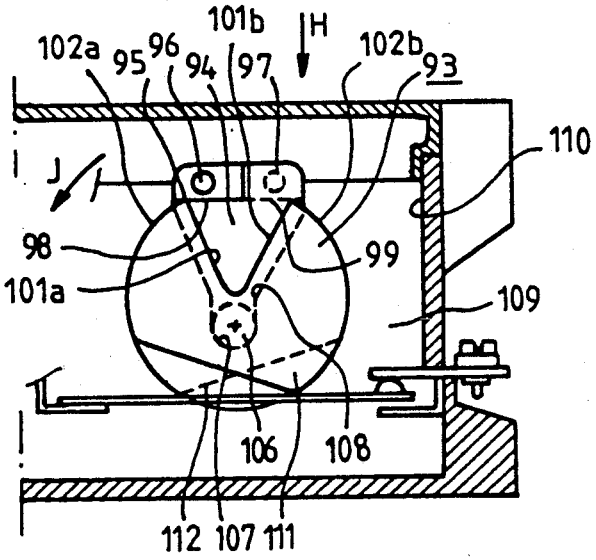
FIG. 17

REVERSING CONTACTOR APPARATUS WITH LOCKING

BACKGROUND OF THE INVENTION

The invention relates to a reversing contactor electric apparatus comprising two electromagnet systems and two power switch systems housed in a common case, which further receives a mechanical locking device preventing simultaneous movement of the mobile armature pieces of these two systems, switches with reciprocal locking being further disposed in the circuits supplying these electromagnets for preventing energization of that one of these two electromagnets which is not concerned.

In such apparatus which are very often used either for feeding multi-phase motors with two directions of operation, or for that of star-delta starters, it is frequently desirable to associate, with the mechanical locking device preventing simultaneous movement of the armatures, an electric locking device preventing simultaneous energization of the coils of the two electromagnets.

Usually, such locking is provided by means of auxiliary switches whose contacts are placed in series with the coils, these switches being either associated externally of the common case or else associated respectively with each of the two adjacent contactors when, for lack of combined apparatus, two separate contactor apparatus must be associated together between which is disposed a mechanical locking device.

However, the fact of using for each contactor, for the purpose of electric locking, one of the switches contained in an auxiliary contact case deprives the user of two switches which could be useful for accomplishing other programs of automatic control and/or signalling, whereas an external wiring operation must be systematically carried out.

The mechanical locking devices frequently comprise two mobile parts, the respective conjugation of the movements of which with those of the armatures give every satisfaction when the relatively narrow manufacturing tolerances are respected, the probabilities of malfunction are however never excluded considering in particular the progressive modifications of their dimensions during large-scale manufacture, which must further accommodate inevitable wear attributable to their operation.

The recent developments in the field concerned result from the needs felt by numerous users of multiphase motors of having apparatus which are simple to mount and connect, even if it entails a complete replacement when only one of the two contactors is damaged.

SUMMARY OF THE INVENTION

The invention consequently provides an electric reversing contactor apparatus whose general construction corresponds to that mentioned above, and in which the electric and mechanical locking means will be completely integrated so as to simplify the task of fitters and that of cable installers or that of maintenance staff, while improving the overall reliability of this apparatus, and not depriving the user of a pair of switches on auxiliary contact cases which he might need by associating them with each of the contactors.

According to the invention, the locking device uses in a way known per se a mobile locking piece placed in the case which may be moved by each of the mobile assemblies of the two electromagnets situated on each side thereof, and which further cooperates with two opening locking electric switches housed in this case and actuated by this mobile piece, one of the terminals of these switches being connected on the inside by a particular conductor to an input of the coil which it controls.

Other complementary objectives, either for obtaining small transverse size for the apparatus or ease of mounting in the factory, or else easy control, will be attained using appropriate measures.

BRIEF DESCRIPTION OF THE DRAWINGS

The invention, as well as examples of application of the apparatus which it concerns, will be better understood from the following description and the accompanying FIGURES which illustrate:

FIG. 14, a simplified and partial sectional view of a second embodiment of the case of the apparatus;

FIG. 16, a partial perspective view of the conductors for forming the circuit of FIG. 15;

FIG. 17, a partial sectional view through a median plane comparable to plane RR' of a second embodiment of a mechanical locking piece;

DESCRIPTION OF THE PREFERRED EMBODIMENTS

Figure 1:
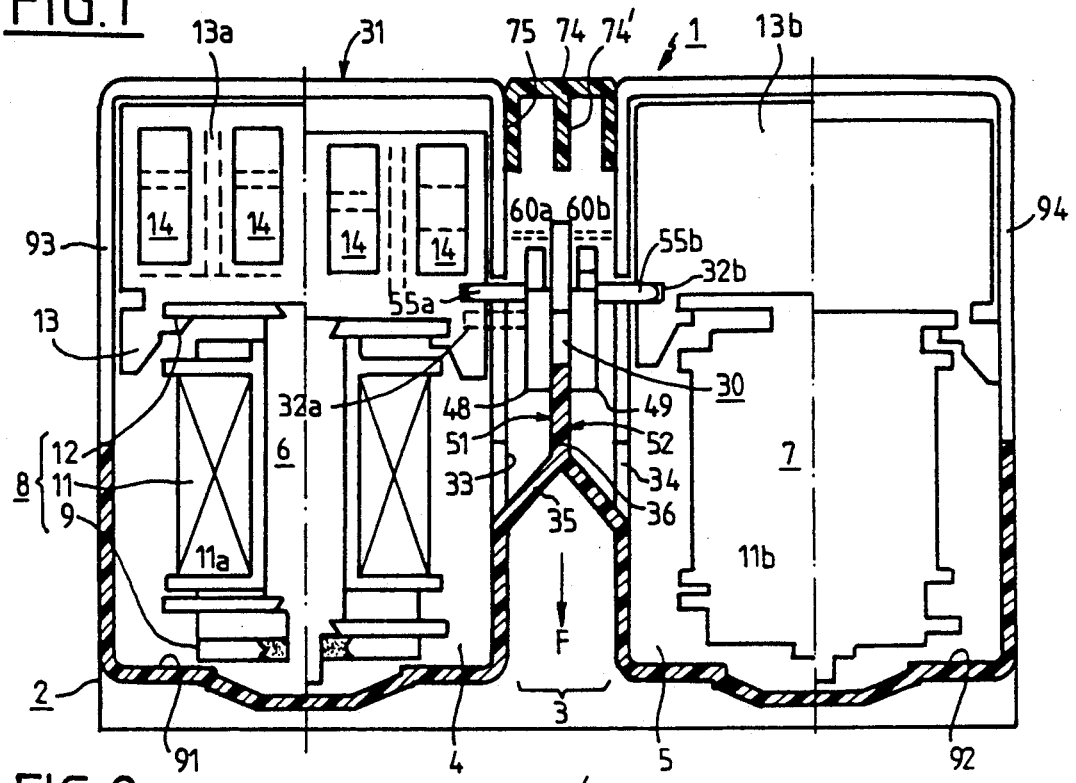
FIG. 1, a section view of the apparatus through a mean plane PP' passing through the two electromagnet systems which it uses.
Figure 2:
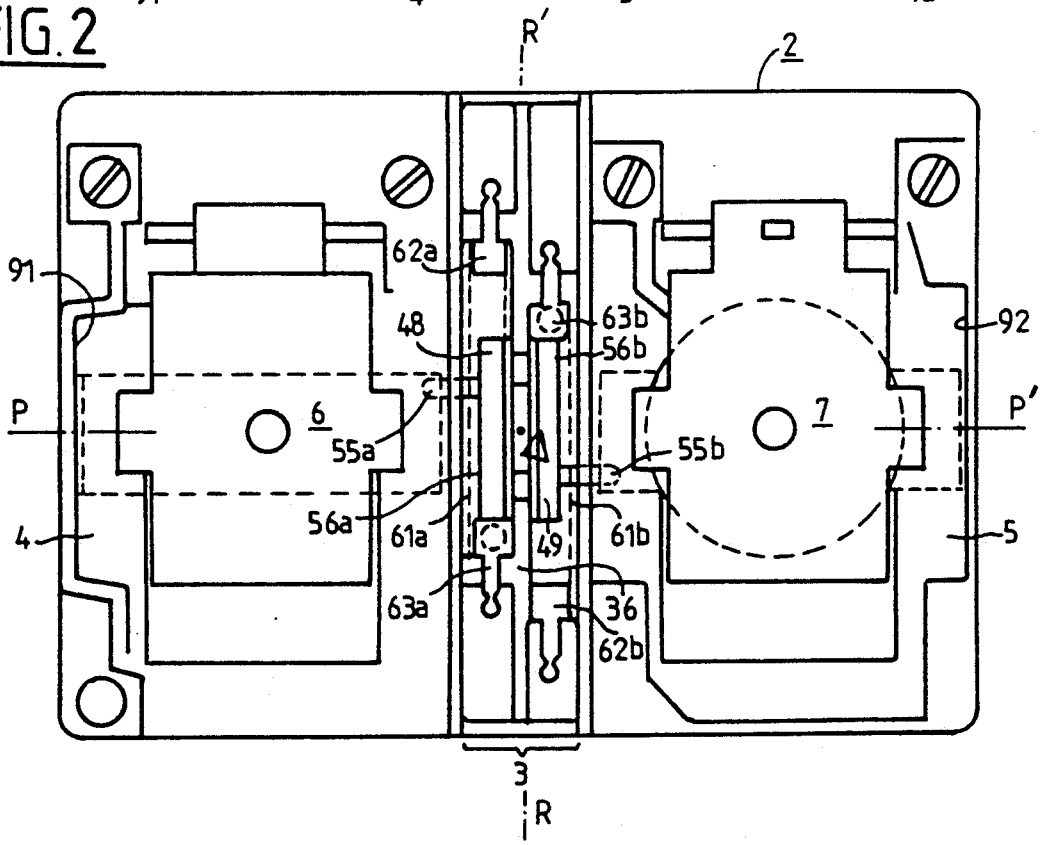
FIG. 2, a top view of FIG. 1 in which the electromechanical locking system and the armatures of the two electromagnets can be seen, because the contact-holder and the front face of the apparatus have been removed.

A reversing contactor apparatus 1, shown in FIGS. 1 and 2, comprises a molded case 2 having, on each side of a central housing 3 through which a median plane RR' of the case passes, two cavities 4, 5 adapted for each receiving a system of power switches with their own electromagnetic control 6, respectively 7.

Each system comprises an electromagnet such as 8 having a fixed yoke 9, an energization coil 11 and a mobile armature 12 which is coupled to a contact-holder 13 receiving mobile contacts of power switches 14. Return springs, not shown, give to these armatures rest positions away from the respective yokes.

Figure 3:
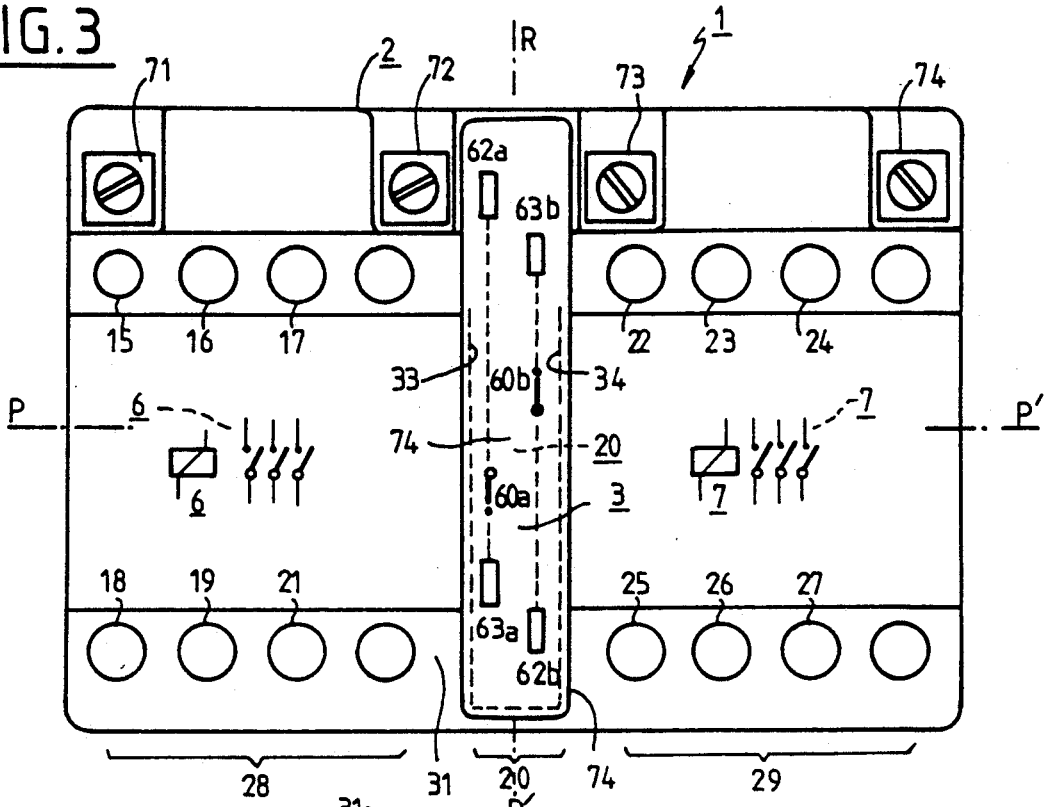
FIG. 3, a top view of FIG. 1.

As can be seen in FIG. 3, the terminals of the power switches 15, 16, 17; 18, 19, 21 and 22, 23, 24; 25, 26, 27 are disposed in two regions 28, 29 of the front face 31 of the apparatus between which the central housing 3 opens into an intermediate region 20.

Each particular contact-holder such as 13*a*, 13*b*, see FIG. 1, has a central groove 32*a*, respectively 32*b*, directed towards the housing 3, the latter being substantially defined by two parallel walls 33, 34 and a complementary wall 35 extended by a central partition 36 placed in the median plane RR' parallel to walls 33, 34.

Figure 4:
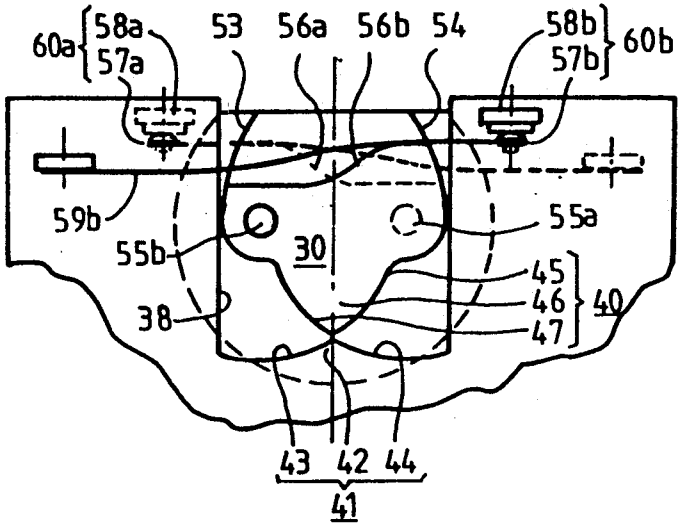
FIG. 4, a side view of the electro-mechanical locking system at rest in a portion of the apparatus from which the electromagnets have been removed.

This partition 36 comprises an indentation 37 open towards the front face 31 of the apparatus and shown in FIG. 4, having two opposite parallel edges 38, 39 and a bottom 41 whose center is occupied by a projection 42 situated in a mean plane PP' common to the two mobile assemblies of the two electromagnets and perpendicular to the plane RR'.

This projection 42 is defined by concave and symmetrical curved surfaces 43, 44 which extend on each side thereof in the plane of the partition wall 36.

Figure 5:
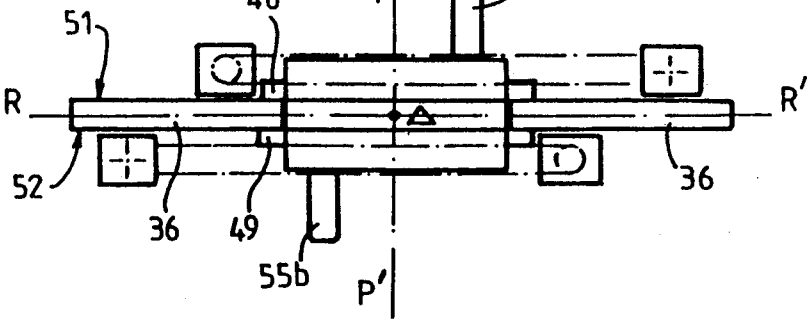
FIG. 5, a local top view of the mechanical elements of the locking system.

As can also be seen in FIG. 4, the indentation is occupied by a mobile locking piece 30 having, in the plane RR' where the partition 36 is located, a cam surface 40 in the form of a heart which is defined by two convex curved surfaces 45, 46 intersecting so as to form an acute apex 47; furthermore, this mobile piece comprises two circular projecting lateral flanges 48, 49 which are parallel on each side of the plane of the cam and which are applied to the opposite faces 51, 52 of partition 36 ending in the indentation, see FIGS. 1, 2 and 5, so as to be able to execute oscillating movements in its plane.

The movements which this mobile piece may make are guided, on the one hand, by the presence on it of these flanges and, on the other hand, because of the contact of lateral guide surfaces 53, 54 of the cam against the edges 38, 39 of the opening. These movements are for example communicated to the mobile locking piece 30 because of the presence of two transverse studs 55*a*, 55*b* which project in opposite directions symmetrically with respect to a line Δ common to the planes of symmetry RR' and PP' so as to penetrate respectively into grooves 32*a*, respectively 32*b*, for coupling with the corresponding contact-holder 13*a*, respectively 13*b*. These studs have parallel axes which each pass substantially through the center of curvature of the convex surfaces 45, respectively 46, from which they are the furthest away.

Figure 6:
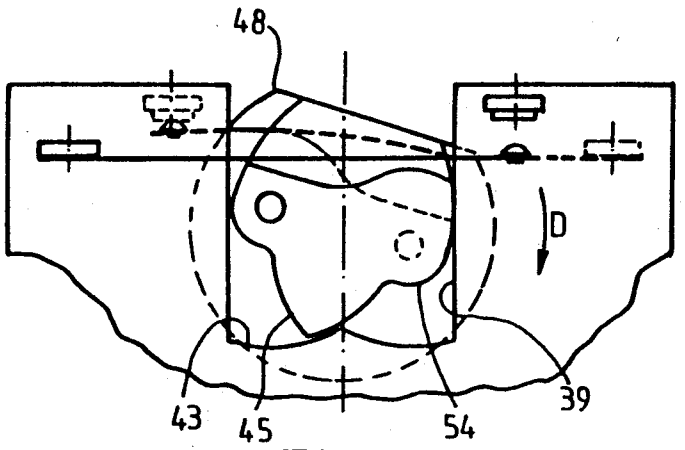
FIG. 6, a side view of the locking system in one of its working positions.
Figure 7:
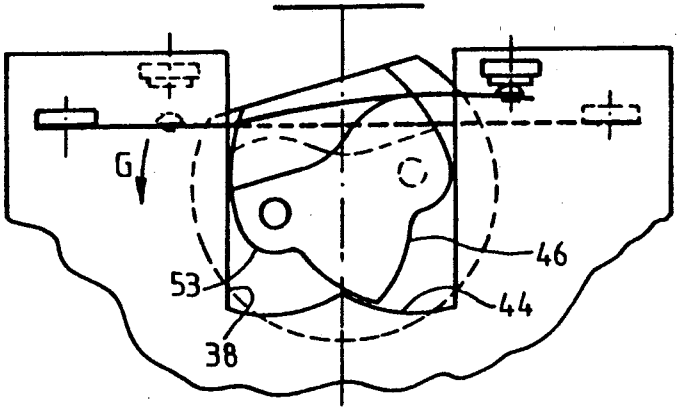
FIG. 7, a side view of the locking system in a working position opposite the preceding one.

Finally, this mobile locking piece has two bosses 6*a*, 56*b* which are disposed symmetrically with respect to this line Δ and which, for some angular positions apply, or not, see FIG. 4, mobile contact pieces 57*a*, 57*b* against fixed contacts 58*a*, 58*b* because of the resilient deformations which they communicate to two flexible blades 59*a*, 59*b* at the ends of which these contact pieces are disposed, see FIGS. 6 and 7. These bosses are disposed in planes parallel to the lateral flanges and externally thereto. These blades extend substantially parallel to plane RR' and to each other.

Each of the switches 60*a*, 60*b*, each formed by a fixed contact and a mobile contact 57*a*, 58*a*, respectively 57*b*, 58*b*, is in the closed state when the mobile locking piece is in a rest position which is illustrated in FIG. 4 and which results from the existence of simultaneous rest states of the two electromagnet systems.

This mobile locking piece, as well as the two electric locking switches which are associated therewith, are placed in the central housing 3 where the partition 36 provides galvanic insulation and transverse guiding; this housing has then, see FIG. 2, at least in its region close to the front face, two pockets 61*a*, 61*b* each receiving a switch as well as input and output terminals 62*a*, 62*b*, respectively 63*a*, 63*b*. As can be seen in FIGS. 2 and 3, and schematically in FIGS. 8 and 9, these terminals belong in pairs 62*a*, 63*a*; 62*b*, 63*b* to electric locking circuits extending parallel to the electric circuits through which the currents of the power switches flow for example from the input terminals 15, 16, 17 to the output terminals 18, 19, 21 and are situated on each side of the mean plane PP'. The terminals 71, 72 and respectively 73, 74 which are accessible from the outside, represent the terminals for connection of the energization coils associated with the two electromagnets 6, respectively 7.

Figure 8:
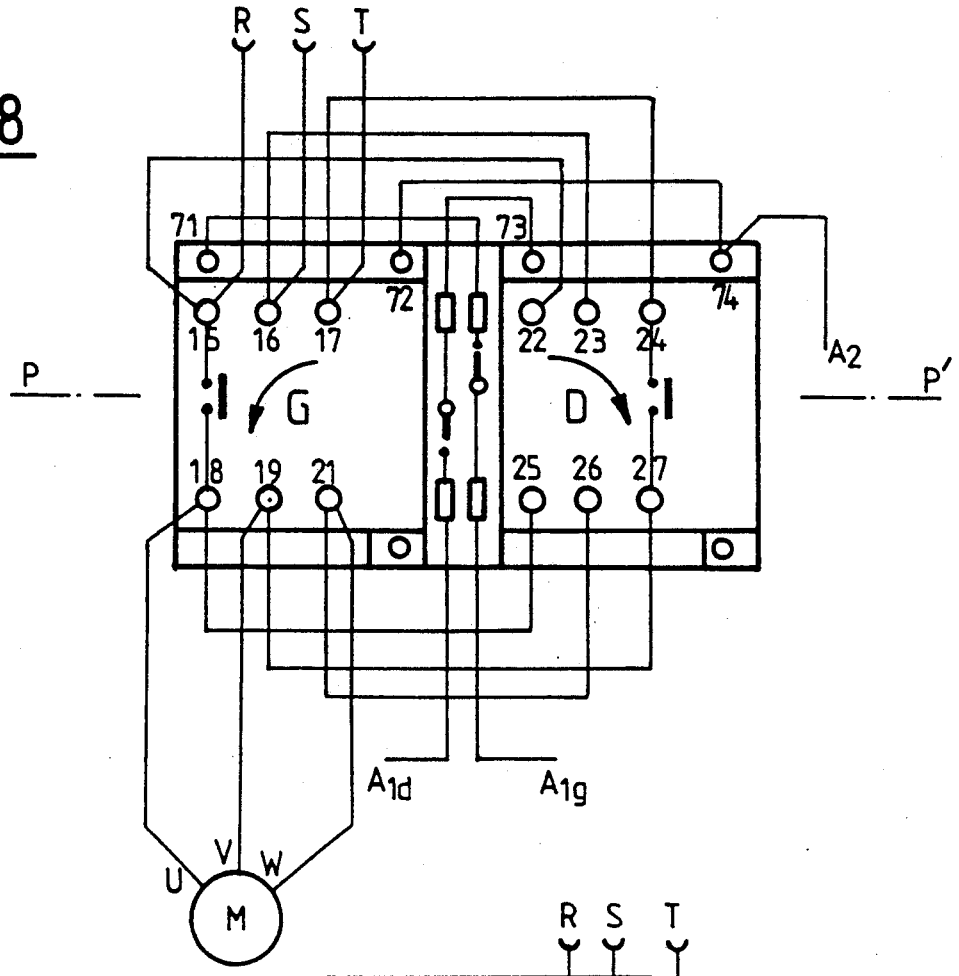
FIGS. 8 and 9, two electric diagrams for connection of apparatus according to the invention applied to a circuit controlling a motor with two directions of operation and, respectively, a star-delta motor starter circuit.
Figure 9:
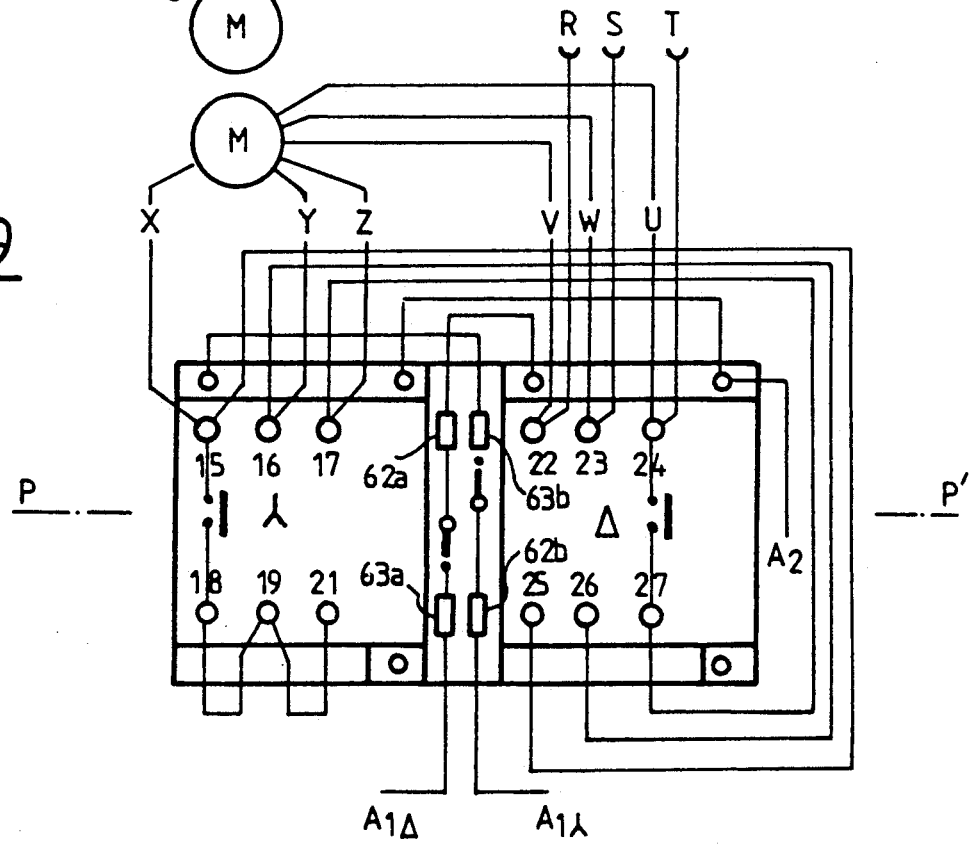

Within the application of the apparatus of the invention to controlling a reversible three-phase motor, respectively to controlling a star-delta motor, terminals of these locking switches, of the energization coils and of these power switches are for example connected electrically by circuits shown in FIGS. 8 and 9.

The operation of the electro-mechanical locking system 20 is readily explained from FIGS. 4, 6 and 7.

If, from a rest position common to the armatures of the electromagnets, see FIG. 4, for which the apex 47 of the cam is opposite the projection 42, the two coils 11*a*, 11*b* were accidentally simultaneously energized, this apex and this projection would come into contact and prevent the simultaneous movement of the armatures in direction F.

When one of the electromagnets is energized before the other, the locking piece rocks in direction G considering the retention action provided by the groove of the armature which is not energized (see FIG. 6), or direction D (see FIG. 7), and prevents any subsequent movement of the armature belonging to that one of these electromagnets which is not energized; such prevention which extends naturally to the electrical consequences resulting for example from a shock, is achieved through the existence of mechanical interaction, on the one hand, between surfaces 43 and 45, respectively 44, 46 and, on the other hand, between the surfaces 53 and 38 or respectively 54 and 39, see FIGS. 6 and 7.

Figure 11:
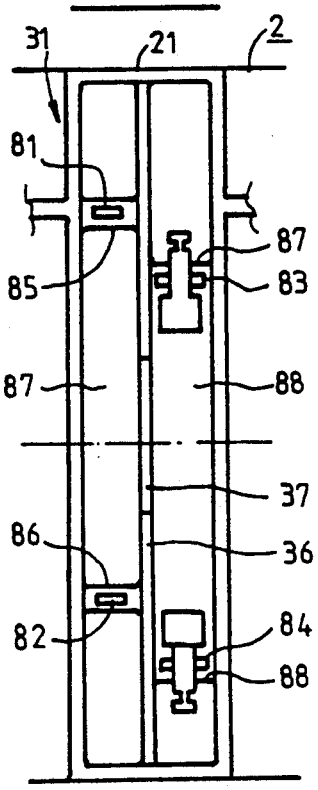
FIG. 11, a top view of the central region of the apparatus, when the cavities which it comprises have the lid and a mechanically interlocking member removed.
Figure 18:
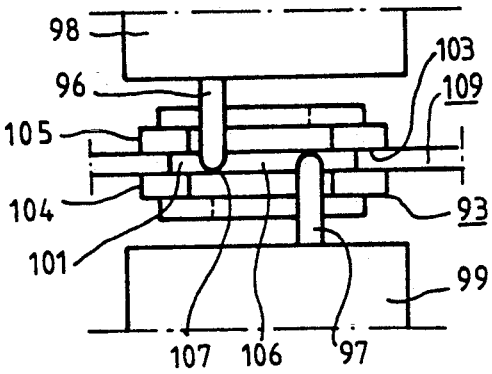
FIG. 18, a partial top view of the locking piece of FIG. 17.
Figure 12:
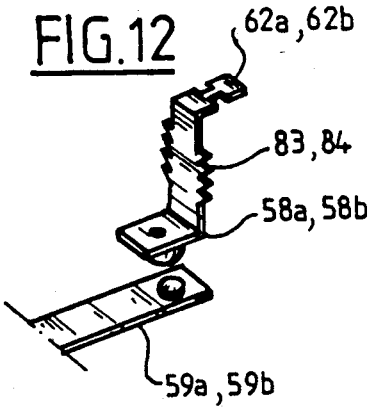
FIG. 12 a perspective view of a detail of construction of an electric locking switch associated with the mechanical interlocking member.

The fitting of the electro-mechanical system 30; 60*a*, 60*b* in its housing 3 is extremely easy because of the proximity of its opening to the front face 31; recesses or grooves such as 81, 82, see FIG. 11, formed in cross-pieces such as 85, 86 integrally molded with the common case 21 in semi-housings 87, 88 provided by the partition 36 permit easy positioning in the factory and efficient coupling of serrated extensions such as 83, 84 belonging to the pieces of terminals 62, 63, see FIG. 12. These cross-pieces further cooperate in stiffening the partition 36.

A front cover 74, shown in FIGS. 1 and 3, closes the opening 75 of the housing at the position where the latter opens into the front face 31 of the apparatus, and forms galvanic insulation not only because of its lateral friction on opposite walls of the apparatus, such as 75, but also because of the presence of a central rib 74' extending partition 36.

In the embodiment shown in FIGS. 1 to 12, the cavity receiving the locking piece and the switches opens into a front face 31 of the apparatus. This arrangement provides ease of mounting when the case 2 or its base, if it has one, have two housings 91, 92 which open in the same direction for receiving an electromagnet system each. Each of these housings is closed during fixing of the cover 93, respectively 94, receiving the power switches 14, their terminals 15 . . . 27 and, if necessary, the corresponding electromagnet armature 13*a*, respectively 13*b*.

Figure 10:
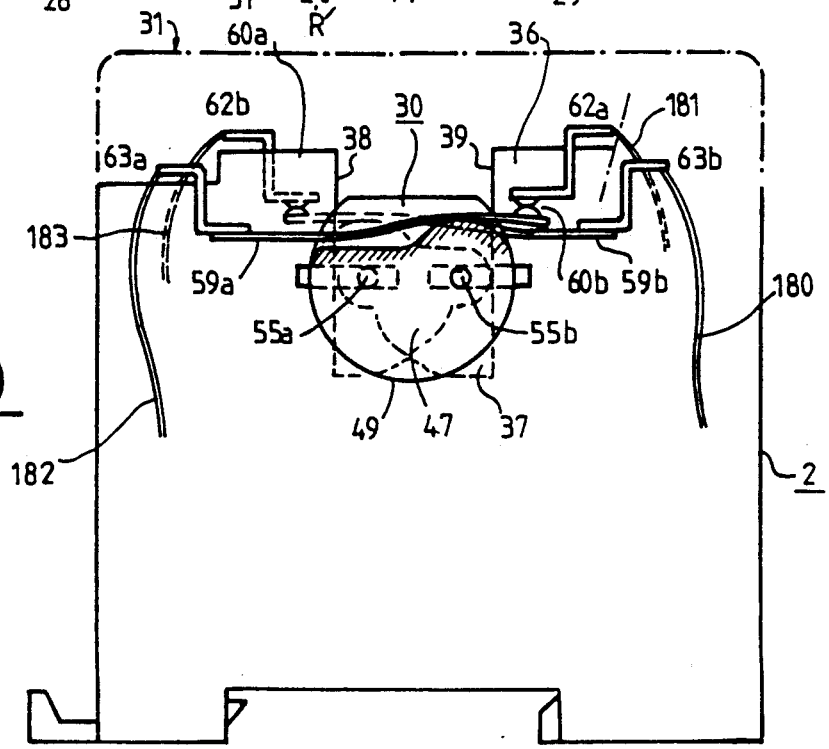
FIG. 10, a partial sectional view of the apparatus according to the invention through a median plane RR' which is perpendicular to the mean plane PP' and passes through a housing adapted for receiving the electromechanical locking device.
Figure 13:
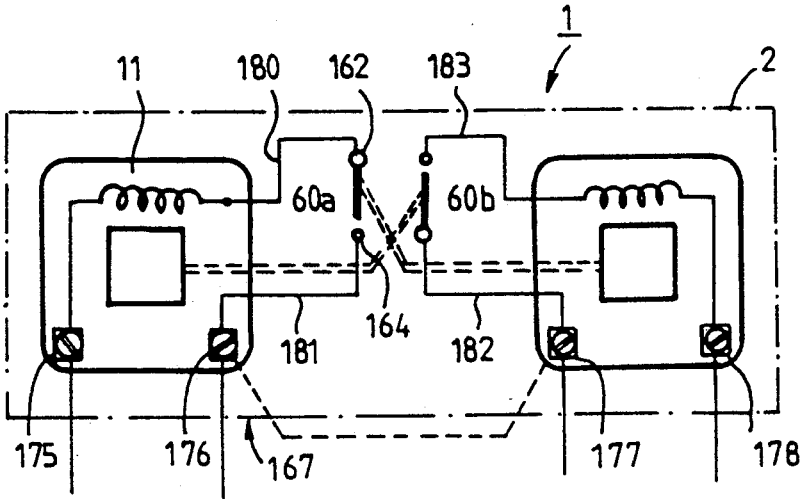
FIGS. 13 and 21, a diagram relative to a first method of internal electric connection between the coil terminals and the safety switches which control their series power supply.

At the same time, this arrangement makes it easy to position flexible connecting conductors or other conducting pieces 180, 181, respectively 182, 183 going from the coil 11 to the associated switch 60*a*, respectively 60*b*, see FIGS. 10 and 13 and allows a final check of the electro-mechanical locking device to be conveniently made before positioning lid 74. The coil thus has usually two connection terminals such as 175, 176; 177, 178.

Embodiments in which the cavity receiving the oscillating locking piece and the switches opens into a rear face or a side face would nevertheless come within the scope of the present invention to the extent that they provide the same advantages of compactness of the apparatus and clearness of its connection to be obtained, while preventing any fraudulous maneuver or making it more difficult.

The heart-shaped cam providing mechanical locking between the two contactor armatures has been presented up to here because of its own qualities which in no wise exclude , within the scope of the present invention, the use of simple oscillating locking means of another kind. FIG. 17 illustrates by way of non limitative example an oscillating locking piece 93 at rest whose simplicity has something in common with the preceding one. This piece 93 has a cut-out in the form of a sector 94 opposite the opening 95 of which are located two pins 96, 97 belonging respectively to each of the two extensions of armatures 98, 99. It can be clearly seen that a movement in direction H of one of these pins, for example 96, by meeting with an edge of the cut-out such as 101, communicates an angular movement in direction J to piece 93 thus bringing its periphery 102 opposite the other pin, so that the movement in the same direction of the armature associated with the latter is prevented and conversely by means of edge 101*a* and periphery 102*a*. A return spring, not shown, may be used for conferring on piece 93 a rest position shown.

As for the preceding locking piece, a groove 103 may also be used here fitted between two lateral flanges 104, 105 of piece 93 so as to provide both transverse holding and a bearing effect by the cooperation of a central core 106 with the rounded bottom 107 of a notch 108 placed in a median wall 109 dividing a central cavity 110 in two.

Figure 19:
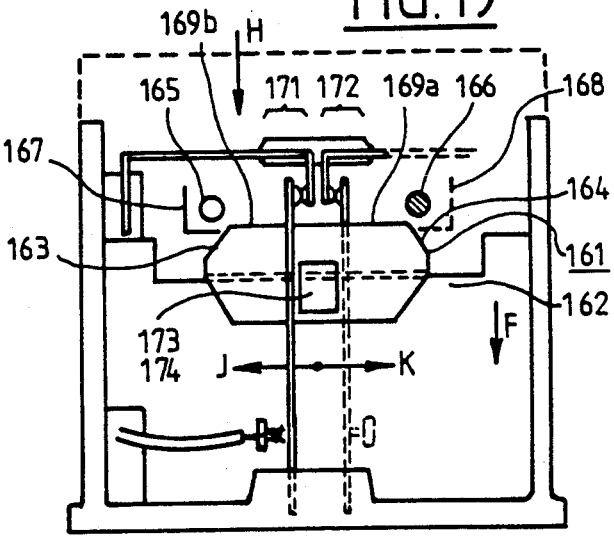
FIG. 19, a partial sectional view, through a median plane comparable to plane RR', of a third embodiment of a mechanical locking piece.
Figure 20:
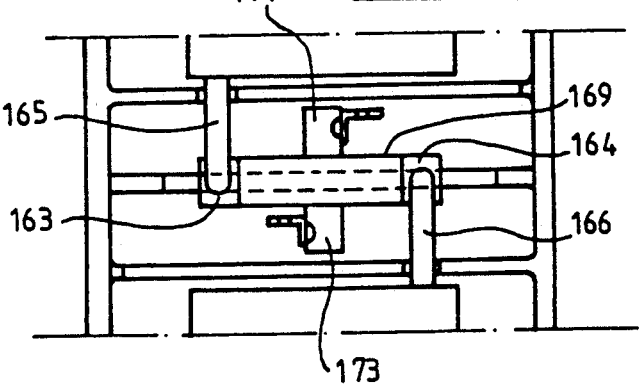
FIG. 20, a partial top view of the locking piece of FIG. 19.

The flanges are here also equipped with radial bosses such as 111, 112 for causing as before movements of resilient blades each carrying a mobile opening switch contact. Among the simple mobile pieces which can be used for mechanical locking, there is also included a slide 161 sliding on a median partition 162 on which it is astride and which is shown in FIG. 19, whose opposite ends 163, 164 are bevelled so as to transform into rectilinear transverse movements —J— or —K— sliding contacts which they receive from one of the two pins 165, 166, movable in direction F, and belonging respectively to or fast with each of the armatures 167, 168. Each of these movements brings under the pin which has not been moved an abutment surface 169*a*, 169*b* preventing any subsequent movement of the armature to be locked. Two flexible blade switches 171, 172 may here again cooperate with the mobile piece, in particular with two transverse and opposite catches 173, 174 so that each interrupts the supply circuit of the coil which was not energized first. Advantageously, the flexible blades may be used for conferring on the slide a central rest position which is shown in FIG. 19, see also FIG. 20.

The conditions laid down by the existence of an internal connection between the switches and the associated coils could also be satisfied, see in particular FIG. 14, through the use of a lower insulating lid 118 closing for example simultaneously the cavity 119 of base 121 opening towards the rear face 122 of such an apparatus 120 and covering cut-outs such as 123*a*, 123*b* in walls letting connecting conductors pass for example from coil 124 to an associated switch 125.

Although less advantageous, cavities opening into the lateral faces of the apparatus could also be used.

Figure 15:
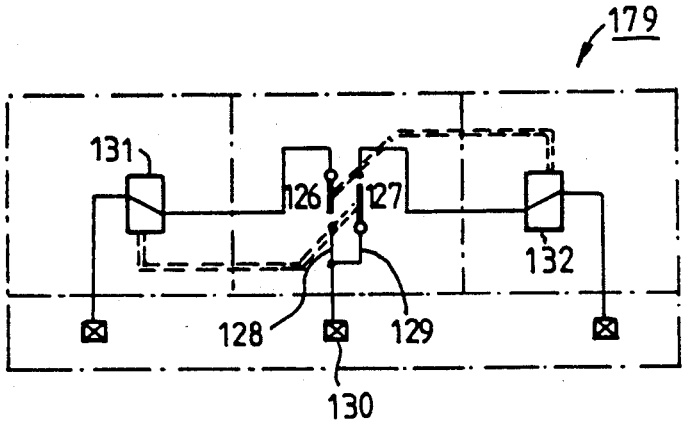
FIG. 15, a diagram relative to a second method of internal electric connection between the coil terminals and the safety switches.

Finally, the immediate proximity of two electric locking switches 126, 127 may be taken advantage of in an apparatus 179 for, on the one hand, connecting together inside the case the return conductors 128, 129 of coils 131, 132, see FIG. 15, and for extending this connection to a single common terminal 130 placed outside the case.

In an advantageous embodiment, shown in FIG. 16, this common terminal 130 has a particular shape 140 which may be formed in a single piece with switch elements 141, 142, one carrying a fixed contact 143 and the other a mobile flexible blade end 144; so as to avoid difficult handling which accompanies the use of long flexible wires, each of the cooperating and opposite elements 145, 146 of the switches may each also be provided with an extension 147, 148 which extends as far as the vicinity of the associated coil 151, 152 where the end of a coil winding wire may be directly connected thereto, for example by soldering 153 , respectively 154.

Figure 21:
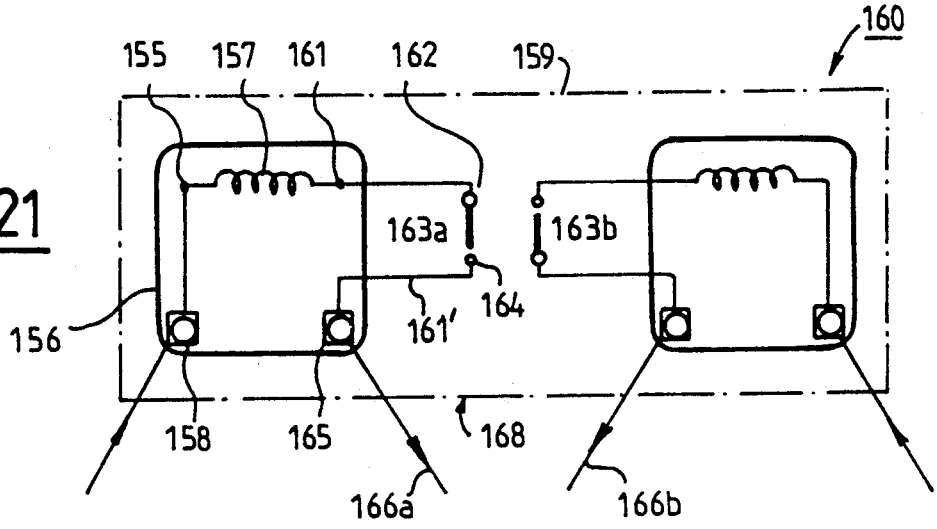

If it is desired to keep the traditional connection method, in which each electromagnet comprises two of its own connection terminals for energization of the corresponding coil, a particular embodiment may also be used for the circuit passing through a coil and the switch which controls it locally, see the diagram of FIG. 21 comparable to that of FIG. 13.

In this embodiment 160, the carcase 156 of the coil 157 has a first terminal 158 which is accessible from outside case 159 and which is connected directly to one end 155 of the winding, whereas the second end 161 of this winding is extended (by a flexible or rigid conductor) as far as an input terminal 162 of the switch 163*a*, respectively 163*b*; an output terminal 164 of this same switch is connected electrically (by a flexible or rigid conductor) to a second terminal 165 disposed on the carcase and serving as wiring relay for an external cable 166*a*, respectively 166*b*, which serves for the current return.

The two second terminals of the coils may also be connected electrically either together for receiving a single return conductor serving both coils, or separately if the need is so felt.

The set of three or four connection terminals of the coils will be advantageously disposed on the same external face 167, respectively 168, of the apparatus 1, respectively 160.

It is also possible to construct a coil carcase such as 156 in FIG. 21, in which the conductors 161, 161' are both represented by conducting pieces anchored in this carcase. A combination of this measure with the arrangement illustrated for example in FIG. 16 would allow these pieces to play the same fixed contact and respectively fixed blade support role.

What is claimed is:

1. An electric reversing contactor comprising:

a casing having first and second compartments located on the respective sides of a central housing;

first and second electromagnet devices having first and second respective coils, first and second energizing circuits respectively connected to said coils;

first and second respective armature pieces, each movable from a rest to a work position when the respective coil is energized by the respective energizing circuit; first and second power switch devices and first and second mechanical linkages, receptively coupling the first and second power switch devices to the first and second armature pieces; said first and second electromagnet devices, power switch devices and mechanical linkages being respectively housed in said first and second compartments;

unitary mechanical and electrical interlocking means placed within the central housing, said interlocking means comprising a movable locking piece having a rest position and first and second actuated positions, first and second locking switches and actuating means coupling said movable locking piece to said first and second locking switches for respectively closing the first switch when the movable locking piece is in the first actuated position, and the second switch when the movable locking piece is in the second actuated position;

first and second further mechanical means, respectively cooperating with said first and second electromagnet devices and with said movable locking piece for preventing simultaneous motion of the first and second armature pieces; and means electrically connecting said switches to said coils for preventing simultaneous energization of said electromagnet devices.

2. The reversing contactor as claimed in claim 1, wherein said central housing has a partition placed in a plane at right angles with the plane of symmetry of the said electromagnet devices, and said locking switches are disposed parallel on the respective sides of said partition, in proximity to a front face of said casing.

3. The reversing contactor as claimed in claim 2, wherein said movable locking piece has a cam surface in the form of a heart having an acute apex and two curved edges having two respective centers of curvature, said partition has an edge, said acute apex being located opposite said edge when the movable locking piece is in the rest position, said locking piece further being provided with two studs respectively projecting in opposite directions from said centers of curvature.

4. The reversing contactor as claimed in claim 3, wherein said locking piece has an oscillating motion from said rest position to said first and second respective actuated positions, and two parallel surfaces respectively projecting from the respective opposite faces of said locking piece, said partition has a cut-out having two opposite edges which guide said oscillating motion, said partition further having two opposite and contiguous parallel faces which serve as guide surfaces for said parallel projecting surfaces.

5. The reversing contactor as claimed in claim 3, wherein said movable locking piece has in its respective faces two bosses which are symmetrically opposite said acute apex, said actuating means including two resilient contact blades respectively cooperating with the respective bosses.

6. The reversing contactor as claimed in claim 2, wherein cross-pieces integrally molded with said casing extend from the respective sides of said partition at right angles thereto and are provided with notches adapted for receiving terminals belonging to said locking switches.

7. The reversing contactor as claimed in claim 2, wherein said central housing opens into a front face of said casing.

8. The reversing contactor as claimed in claim 1, wherein said central housing opens into a rear face of said casing.

9. The reversing contactor as claimed in claim 1, wherein the movable locking piece is a slide moving longitudinally in a plane parallel to said partition and subjected to a centering effect in its rest position.

10. The reversing contactor as claimed in claim 1, wherein the movable locking piece has a notch in the form of a sector having two opposite edges, said further mechanical means comprising two pins which respectively push back said opposite edges.

* * * * *